United States Patent [19]

Sucato

[11] 4,424,000

[45] Jan. 3, 1984

[54] BILLET TURNER

[75] Inventor: Justin F. Sucato, West Seneca, N.Y.

[73] Assignee: Bethlehem Steel Corporation, Bethlehem, Pa.

[21] Appl. No.: 336,793

[22] Filed: Jan. 4, 1982

[51] Int. Cl.[3] ..... B21B 39/20

[52] U.S. Cl. ..... 414/780; 198/411; 414/781

[58] Field of Search ..... 414/754, 761–766, 414/780–784; 198/411, 412

[56] References Cited

U.S. PATENT DOCUMENTS

| | | | |
|---|---|---|---|
| 1,881,168 | 10/1932 | Brosius . | |
| 2,815,867 | 12/1957 | Ewaldson et al. | 414/783 X |
| 3,308,969 | 3/1967 | Orms et al. . | |
| 3,506,141 | 4/1970 | Thomas . | |
| 3,933,253 | 1/1976 | Gardner | 414/763 X |

FOREIGN PATENT DOCUMENTS

| | | | |
|---|---|---|---|
| 2427172 | 2/1980 | France | 414/763 |
| 24207 | 11/1962 | German Democratic Rep. | 414/781 |
| 1568207 | 5/1980 | United Kingdom | 414/754 |
| 507376 | 4/1976 | U.S.S.R. | 414/780 |

*Primary Examiner*—Leslie J. Paperner

*Attorney, Agent, or Firm*—John I. Iverson; John J. Selko

[57] ABSTRACT

Method and apparatus for rotating elongated workpieces on a support bed to present successive faces for inspection and/or treatment of the workpiece. Safe means are provided for rotating hot or cold billets on a support bed in a manner that uses a minimum of manpower while handling pieces of considerable length and weight.

5 Claims, 7 Drawing Figures

10
11
12
13
14
15
16
16'
17
17'
18
18'
19
20
21
22
23
24
25
26
27
28
29
30
31
33
34
35
36
37
40
3
4

AIR SUPPLY
AIR MANIFOLD
HYDRAULIC
AIR
18
23
27
28
32
32'
33
34
37
20
26
50
51
52
53
54
55
56

BILLET TURNER

BACKGROUND OF THE INVENTION

This invention relates generally to billet processing method and apparatus and more particularly to rotating heavy generally rectangular elongated workpieces on a support bed, as e.g. steel blooms and billets.

The hot metals industry produces billets, blooms and other substantially rectangular shaped elongated semi-finished workpieces of considerable length and weight. These workpieces are rotated on their supports to present different faces for inspection and/or reconditioning, as e.g., by grinding. Frequently the inspections require turning the same piece for a second four-side inspection. One known method for turning the workpieces is by magnet equipped overhead cranes, a process which is very awkward and time consuming and often results in damage to the handling equipment and the workpiece surfaces.

Workpieces, either hot or cold, that have been stored on support beds for cooling, inspection, reconditioning and/or transfer become cambered and require costly gag straightening prior to reconditioning.

For example, billets rolled on a bar mill are stacked to cool on cooling beds. The stacking and cooling process results in billet camber on a portion of the billets. It is advantageous, because of stringent mill requirements for straightness, to turn these billets 90° prior to their removal from the cooling beds. The need for gag straightening is reduced or eliminated. When the elongated workpieces are rotated 90° on the support or cooling bed after cambering, they tend to settle back onto the bed in a straighter condition than before as will be readily understood by those skilled in the art.

The conditions described above require frequent turning of the elongated workpieces. The small section and shorter length workpieces produced in the past were generally turned manually on the cooling beds with wrenches on one or both ends. The larger section longer length workpieces produced currently cannot be rotated manually because of the substantial force requirements. The larger workpieces cool more slowly and therefore present an intolerable environment to a manual turning effort.

SUMMARY OF THE INVENTION

It is an object, therefore, of this invention to provide apparatus that will rotate elongated workpieces about an edge thereof safely and efficiently.

It is a further object of the invention to provide apparatus that will rotate a billet about its edge when located on a support bed and displace it to provide space to rotate the next billet on the bed.

It is a still further object of the invention to provide a method for displacing long, heavy and hot workpieces expeditiously on a support bed.

The present invention accomplishes these objects by providing a carriage mounted on tracks adapted for movement alongside a support bed with a turning unit mounted thereon having a cradle, e.g. a U-shaped jaw, mounted at one end of the turning unit for engaging the end of an elongated workpiece on the support bed and rotating the workpiece about an edge through at least 90° to present a new face for inspection and/or conditioning. The axis of the turning unit is substantially coincident with the extension of the edge about which the workpiece is to be turned.

DESCRIPTION OF THE PREFERRED EMBODIMENT

Figures 1, 4:
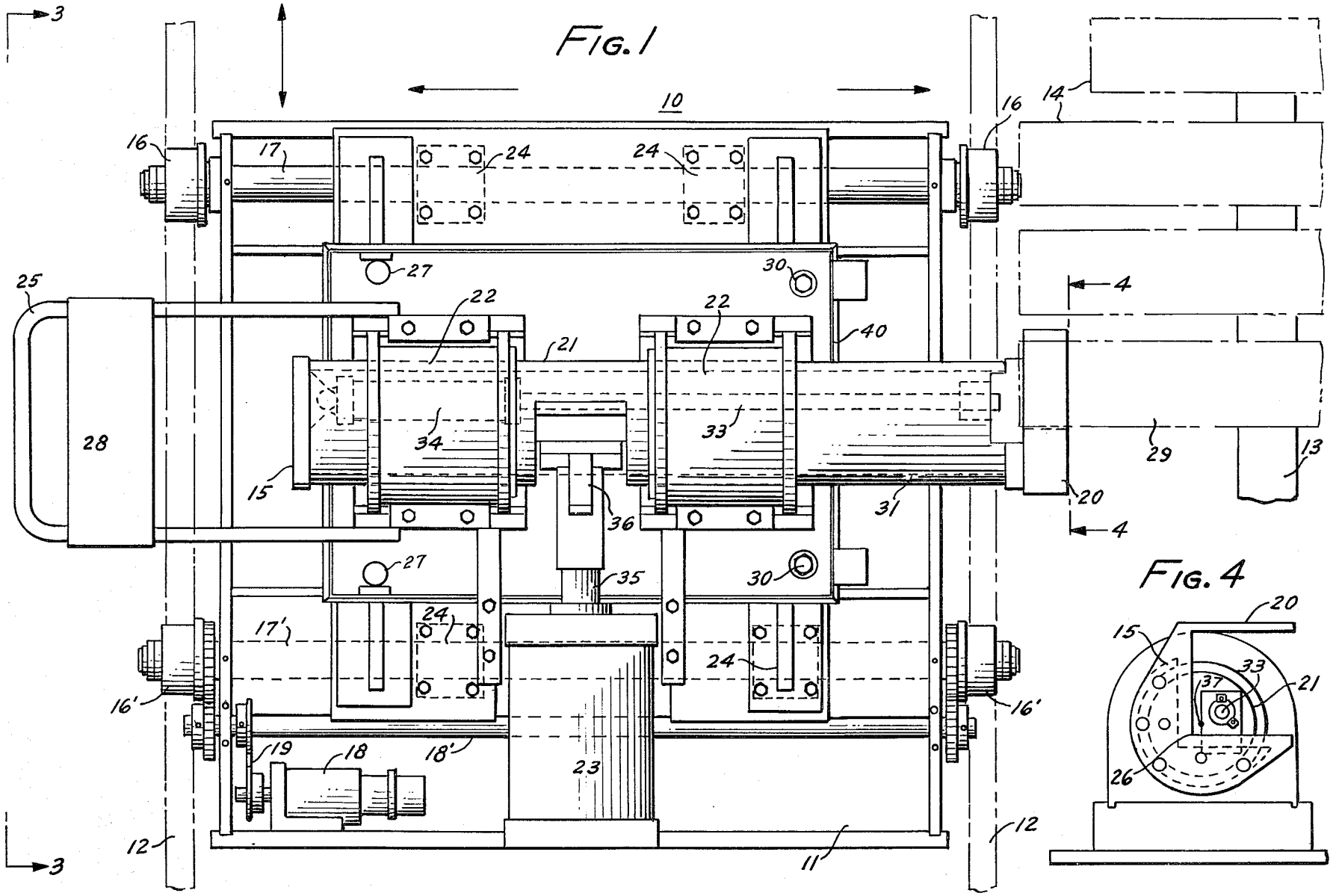
FIG. 1 is a plan view of the apparatus of the invention.
FIG. 4 is a fragmentary detail drawing of the U-shaped jaw taken on line 4—4 of FIG. 1.
Figure 2:
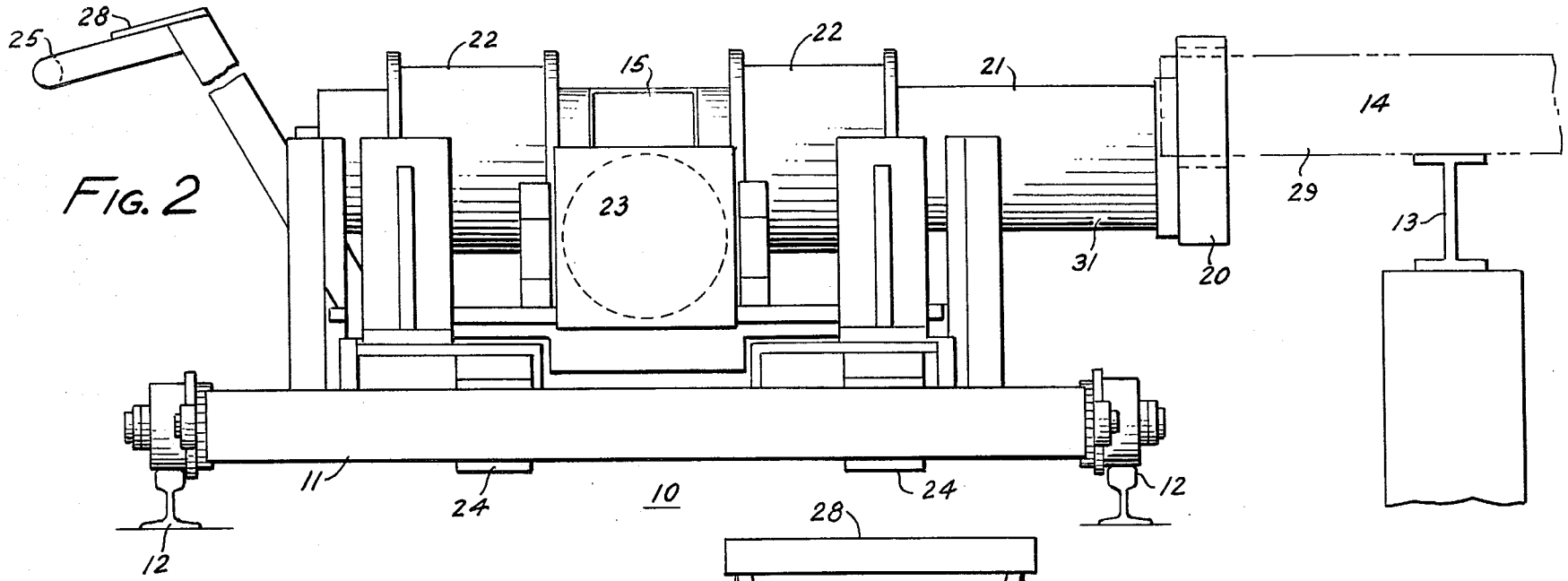
FIG. 2 is a side elevation of the apparatus of FIG. 1.
Figure 3:
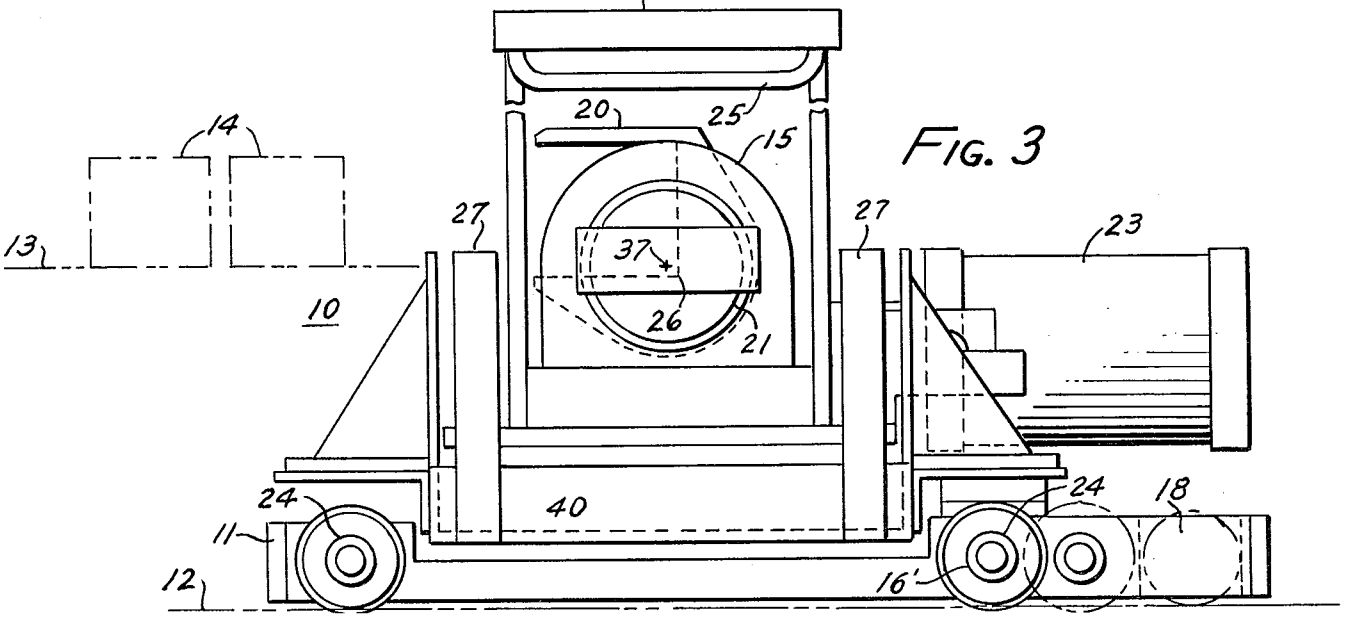
FIG. 3 is an end view of the apparatus taken on line 3—3 of FIG. 1.

Referring now to the drawings for a detailed description of the billet turner 10 of this invention and more particularly to FIGS. 1–3 inclusive, the billet turner of this invention is seen to comprise generally a carriage 11 mounted on tracks 12 for movement alongside cooling or support bed 13 with elongated workpieces 14 resting thereon.

The billet turner 10 includes a bottom carriage unit 11 and a top or turning unit 15. The carriage unit 11 provides the movement of the billet turner in the transverse and longitudinal directions. The carriage unit 11 is mounted on wheels 16,16' which are at the ends of stainless steel shafts 17,17' and the unit is powered for movement alongside the support bed 13 by a pneumatic piston motor 18 and chain sprocket drive 19 to an intermediate shaft 18' geared to the two wheels 16'. The carriage 11 includes a depressed center or box 40 mounted on bearings 24 on shafts 17,17'.

The top turning unit 15 has an axis 37 transverse to the movement of the carriage with a cradle 20 removably mounted on one end of the hollow shaft 21 of turning unit 15 and has means to rotate the turning unit 15 and cradle 20 about the turning unit axis. The top or turning unit 15 is free floating, i.e. independent of but mounted on the carriage 11 in the depressed center of box 40 and comprises a cradle or U-shaped jaw 20 removably mounted on an end of a hollow shaft 21 supported between brass bearings 22 and rotated by pneumatic cylinder 23. When actuated, the rod end 35 of pneumatic cylinder 23 which is pivotally attached to operating arm 36 attached to hollow shaft 21 rotates the hollow shaft 21 and U-shaped cradle or jaw 20 through a rotation of 90° about the axis of the turning unit 15. When the cradle or U-shaped jaw 20 engages a billet and is rotated 90° the billet is rotated about an edge thereof to present the next successive face of the billet.

The top or turning unit 15 with U-shaped cradle or jaw 20 mounted on the end thereof is supported in the depressed center of box 40 in free floating fashion as hereinbefore described. The turning unit 15 with cradle or U-shaped jaw 20 mounted thereon is moved onto the end of an elongated workpiece, e.g. a billet. The movement of the turning unit 15 with U-shaped cradle or jaw 20 can be accomplished manually as by an operator pushing or pulling on control bar 25 to cause the carriage 11 to slide on shafts 17,17' to move the cradle toward and away from the support bed to engage the end of the elongated workpiece within the cradle. An inner corner 26 of the U-shaped cradle or jaw 20 is substantially coincident with the axis 37 of the turning unit 15 so that as the turning unit cradle rotates the workpiece 90° in a direction away from the next adjacent billet the workpiece will be displaced to allow room for the turning unit cradle to engage and rotate the next successive billet.

The length of stroke of pneumatic cylinder 23 limits the rotation of the turning unit 15 to 90° which is sufficient to present the next face of an elongated workpiece for inspection.

Means to adjust the turning unit vertically is provided by a pair of hydraulic cylinders 27 mounted on the top turning unit 15 adjacent the control panel 28 on control bar 25 which permits the operator to raise and/or lower the control end of top turning unit 15 a few inches for adjustment of the cradle or U-shaped jaw 20 to accommodate slight deviations in the position of the overhanging ends 29 of the workpiece due to variations in the height of the bed with respect to the tracks 12 or to camber or hooked ends on the workpiece resting on the support or cooling bed 13. The front end 31 of the top turning unit 15 adjacent the cradle or U-shaped jaw 20 is provided with adjustment bolts 30 for adjusting the level of the front end 31 of the free floating turning unit 15 to align with the workpieces overhanging the cooling or support beds 13.

Referring now particularly to FIG. 4 a fragmentary detail of a cradle 20 is seen to comprise a U-shaped member removably mounted as by bolts on the end of the turning unit 15. The cradle appears as a substantially C-shaped jaw when in alignment with a workpiece in preparation for turning and when rotated through 90° will appear as a U-shaped jaw with the opening of the U upward. The turning cradle 20 as referred to herein is described generally as a U-shaped jaw.

Figures 5, 6, 7:
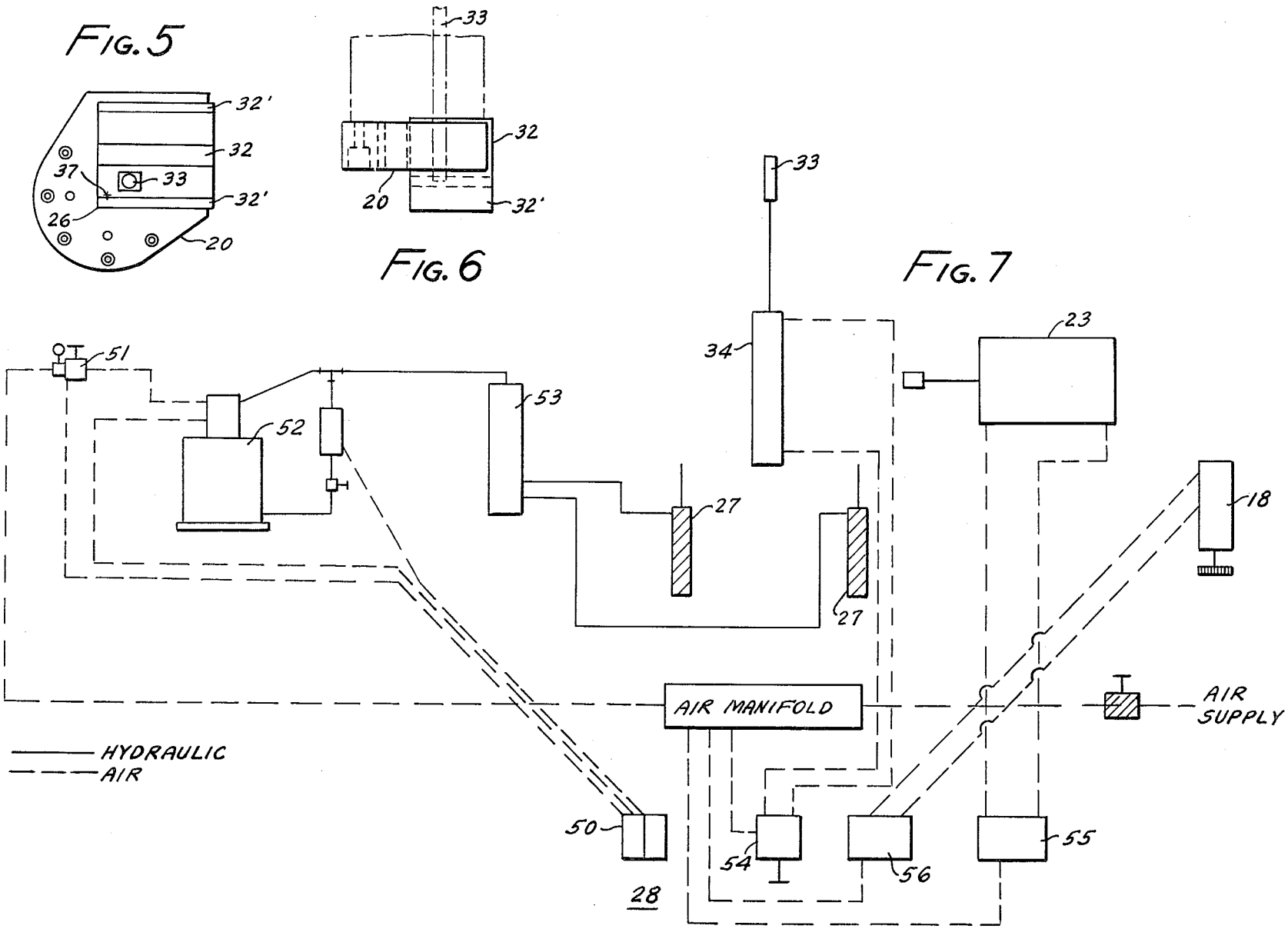
FIG. 5 is a front view of an alternate embodiment of the jaw portion of the apparatus.
FIG. 6 is a top view of the alternate embodiment of FIG. 5.
FIG. 7 is a schematic drawing of the fluid control system for operating the apparatus of the invention.

FIG. 5 is a detail of an alternate embodiment of a cradle which is adapted to be inserted within the U-shaped jaw 20. The insert may be used to adjust the size of the cradle opening. A base portion 32 is inserted into the opening of the U-shaped jaw 20 and affixed thereto. Flanges 32' extend outwardly from jaw 20 and are aligned with the upstanding legs of the U-shaped jaw. The flanges 32' cradle the workpiece 14 in a manner similar to the U-shaped jaw 20 and rotate the workpiece 14 in the same manner, i.e., the inner corner of the U-shaped jaw is substantially coincident with the axis of the turning unit 15 and the extension of the edge of the workpiece around which the workpiece is to be turned.

FIG. 6 is a top view of the alternate embodiment shown in FIG. 5. Flanges 32' extend outward from base portion 32 which is removably fixed to the U-shaped jaw 20. The flanges 32' may be tapered slightly to open up the space between the flanges to accommodate the cambered or hooked ends of workpieces overhanging the support bed 13.

FIG. 7 is a schematic drawing of the pneumatic and hydraulic control systems for operating the billet turner of the instant invention.

The billet turner 10 is operated by means of hydraulic and pneumatic systems controlled by the billet turner operator from control panel 28. The elevating cylinders 27 are controlled by the up/down button 50. The system for operating the elevating cylinder 28 is hydraulic and includes pressure gauge and control 51, power unit 52 and hydraulic manifold 53. The hydraulic power unit 52 includes a pump with a one gallon tank and pendant control release valve with pendant control.

The system for operating the travel of the carriage 11, the ejector and the rotation of the turning unit 15 is pneumatic. The air for the pneumatic system is supplied from existing plant lines at a pressure of about 80 psi.

The pneumatic cylinder for operating ejector 33 is activated by palm button 54. Toggle switch 55 activates the pneumatic cylinder 23 which rotates the top turning unit 15. The carriage 11 travel back and forth on tracks 12 is controlled by toggle switch 56 which activates pneumatic piston motor 18.

In operation

It is desired to turn a lift of elongated workpieces as, e.g. billets rolled on the 30"/21" billet mills which are stacked to cool on the cooling beds. The stacking and cooling process results in billet camber on a portion of the billets. Tracks are provided for a track mounted billet turner for movement alongside the cooling bed. The billet turner turns all billets 90° prior to their removal from the bed. The rotated billets tend to settle back to the bed in a straighter condition than billets that have not been rotated. As a result fewer billets require straightening at a gag straightener a time-consuming process requiring transportation to the gag location and return.

The billets rolled on the 30"/21" mills are usually 6½" square and average 38 feet long and up to about 5800 pounds in weight. The billet turner of this invention is capable of turning all of the billet sizes rolled for the 13" bar mill. The billet turner of this invention furthermore enables the above described billets to be turned on the hot bed at temperatures of 800°–1000° F. while the operator, separated from the hot billets by the billet turner protected from the heat of the billets by heat shields mounted on the billet turner if desired, merely guides the billet turner from one billet to the next.

The operator controls the operation of the billet turner from a control panel 28 mounted conveniently on control bar 25. The billet turner 10 is moved along tracks 12 by the activation of pneumatic piston motor 18 which drives wheels 16' on shaft 17'. Idler wheels 16 are mounted on a similar shaft 17 so that the entire carriage 11 which supports the top turning unit 15 is controlled in its movement alongside the cooling bed to alignment with the first elongated workpiece to be rotated. When the carriage is properly aligned alongside the cooling bed the pneumatic motor is deactivated. The top turning unit 15 with the open side of the U-shaped jaw or cradle 20 rotated to face the overhanging end of the elongated workpiece to be turned is moved manually by the operator by means of the control bar 15 and the mounting of the top turning unit on the depressed center box 40 slidable on shafts 17,17' toward the overhanging end of the workpiece so that the end is cradled in the U-shaped portion of the end of the turning unit. With the overhanging end of the workpiece cradled in the jaw of the turning unit the operator activates pneumatic cylinder 23 to rotate the turning unit 15 90° with cradle 20 mounted on the end thereof. After turning, in the event that the cradle is not readily withdrawn from the overhanging end of the elongated workpiece, an ejector shaft 33 is advanced by means of hydraulic cylinder 34 toward the workpiece end and engages the end face forcing the top turning unit 15 rearward on shafts 17,17' free of the workpiece.

I claim:

1. Apparatus for rotating an elongated workpiece about an edge when located on a support bed, comprising:

(a) a carriage, mounted on tracks, for movement alongside the support bed, (b) a free floating turning unit, mounted on the carriage, said turning unit having a control end and a front end and having an axis transverse to the movement of the carriage, with a cradle having an opening to engage the end of the elongated workpiece mounted on one end of the turning unit and having means to rotate the turning unit and cradle about the turning unit axis, (c) means to move the cradle toward and away from the support bed, and (d) a first means to adjust the control end vertically and a second means to adjust the front end vertically.

2. Apparatus according to claim 1 wherein the cradle is a U-shaped jaw mounted on the end of the turning unit and the extension of the edge of the workpiece is substantially coincident with an inner corner of the U-shaped jaw and the axis of the turning unit.

3. Apparatus according to claims 1 or 2 including (d) ejector means mounted on the turning unit to separate the turning unit from the end of the elongated workpiece.

4. Apparatus according to claim 3 further including (e) means to adjust the size of the cradle opening.

5. Apparatus according to claim 4 wherein the means described in subparagraph (e) includes an insert removably fixed in the cradle opening.

* * * * *